US010594015B2

(12) United States Patent
Kumar et al.

(10) Patent No.: US 10,594,015 B2
(45) Date of Patent: Mar. 17, 2020

(54) DUAL PURPOSE HEAT PIPE AND ANTENNA APPARATUS

(71) Applicant: Intel Corporation, Santa Clara, CA (US)

(72) Inventors: Praveen Kumar, Bangalore (IN); Bijendra Singh, Bangalore (IN); Saku Lahti, Tampere (FI); Seppo Vesamaki, Tampere (FI); Marko Bonden, Tampere (FI)

(73) Assignee: Intel Corporation, Santa Clara, CA (US)

( * ) Notice: Subject to any disclaimer, the term of this patent is extended or adjusted under 35 U.S.C. 154(b) by 222 days.

(21) Appl. No.: 15/609,144

(22) Filed: May 31, 2017

(65) Prior Publication Data

US 2018/0351230 A1 Dec. 6, 2018

(51) Int. Cl.

| | |
|---|---|
| ***H01Q 1/00*** | (2006.01) |
| ***F28D 15/02*** | (2006.01) |
| ***F28D 15/04*** | (2006.01) |
| ***F28F 21/04*** | (2006.01) |
| ***F28F 21/06*** | (2006.01) |
| ***H01Q 1/02*** | (2006.01) |
| ***H01Q 1/42*** | (2006.01) |
| ***H01R 24/40*** | (2011.01) |
| ***H01Q 1/24*** | (2006.01) |
| ***H01Q 1/44*** | (2006.01) |
| *F28D 21/00* | (2006.01) |

(52) U.S. Cl.

CPC ..... *H01Q 1/002* (2013.01); *F28D 15/0275* (2013.01); *F28D 15/046* (2013.01); *F28F 21/04* (2013.01); *H01Q 1/243* (2013.01); *H01Q 1/44* (2013.01); *F28D 15/02* (2013.01); *F28D 15/04* (2013.01); *F28D 2021/0028* (2013.01)

(58) Field of Classification Search

CPC ..... H01Q 1/002; H01Q 1/243; H01Q 1/244; F28D 15/02; F28D 15/0275; F28D 15/04; F28D 15/046; F28D 2021/0028

USPC ..... 165/104.33, 104.26

See application file for complete search history.

(56) References Cited

U.S. PATENT DOCUMENTS

| | | | | |
|---|---|---|---|---|
| 3,535,543 | A | 10/1970 | Dailey | |
| 4,851,856 | A | 7/1989 | Altoz | |
| 5,099,254 | A | 3/1992 | Tsukii et al. | |
| 5,293,171 | A | 3/1994 | Cherrette | |
| 5,642,776 | A * | 7/1997 | Meyer, IV | F28D 15/0233 165/104.26 |
| 5,908,508 | A * | 6/1999 | Vanell | C23C 16/455 118/723 E |
| 6,233,490 | B1 | 5/2001 | Kasevich | |
| 6,377,219 | B2 | 4/2002 | Smith | |
| 9,160,392 | B2 * | 10/2015 | Bartholomew | H04B 1/3833 |
| 2004/0217472 | A1 | 11/2004 | Aisenbrey et al. | |
| 2007/0267178 | A1 * | 11/2007 | Hou | F28D 15/046 165/104.26 |

(Continued)

*Primary Examiner* — Joel M Attey

(74) *Attorney, Agent, or Firm* — Eschweiler & Potashnik, LLC

(57) ABSTRACT

A heat pipe is provided that is adapted for use as part of an antenna. The heat pipe includes a first conductive shell portion; a second conductive shell portion; and an insulating shell portion disposed between and connected to the first conductive shell portion and the second conductive shell portion. A wick structure is disposed within the sealed chamber.

17 Claims, 3 Drawing Sheets

(56) References Cited

U.S. PATENT DOCUMENTS

2015/0244063 A1* 8/2015 Sowpati ..... H01Q 1/243
343/702

* cited by examiner

DUAL PURPOSE HEAT PIPE AND ANTENNA APPARATUS

FIELD

The present disclosure relates to the field of thermal solutions and antennas and in particular to heat pipes and antennas used in mobile devices to transmit and receive a radio frequency (RF) signal.

BACKGROUND

Communication devices such as smartphones and tablets are becoming smaller and thinner while providing higher performance and drawing more power. These design trends pose problems in the packaging of antennas in light of the larger thermal solutions that are necessary to address the increasing power consumption. Thermal solutions are more complex and now often include heat pipes that draw heat from the processing components and dissipate the heat to the outside of the device. Heat pipes are efficient at removing heat from processing components, but take up a considerable amount of space within the device.

BRIEF DESCRIPTION OF THE DRAWINGS

Some examples of circuits, apparatuses and/or methods will be described in the following by way of example only. In this context, reference will be made to the accompanying Figures.

DETAILED DESCRIPTION

Figure 1:
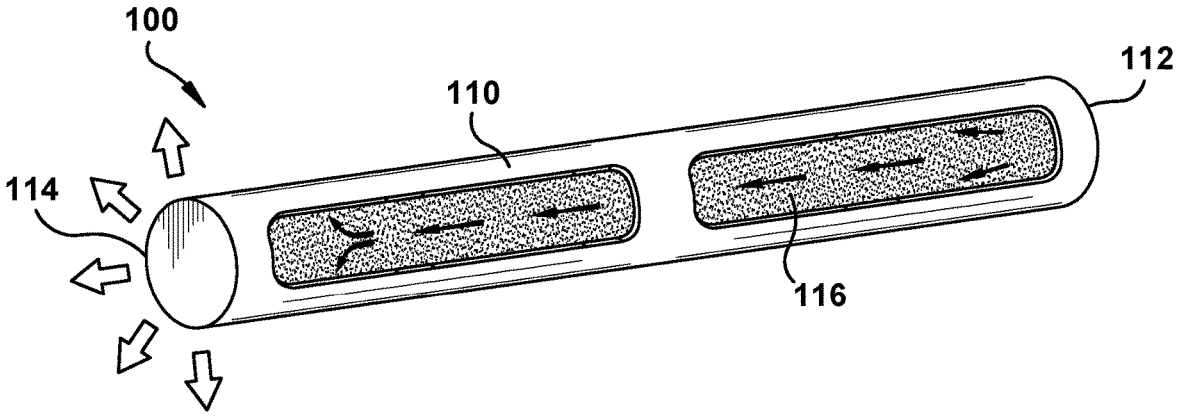
FIG. 1 illustrates an exemplary heat pipe.

The demand for sleeker but higher performance mobile devices is growing. These device designs have begun adopting heat pipe/heat chamber based thermal solutions to meet high performance/power requirements. Mobile devices are extremely packed with processing components and the volume within the devices is very constrained. This makes it difficult to place an antenna within the device while providing appropriate isolation from electrically conductive components. The placement of the antenna sometimes involves a sacrifice of device performance and/or an increase in device thickness.

Described herein are thermal solutions in which a heat pipe is adapted for use as part of a radiating element of a device's antenna. This combined use of the heat pipe as a thermal solution as well as part of an antenna efficiently utilizes space within the device and opens up additional antenna design options as will be described in more detail below.

In the following description, a plurality of details is set forth to provide a more thorough explanation of the embodiments of the present disclosure. However, it will be apparent to one skilled in the art that embodiments of the present disclosure may be practiced without these specific details. In other instances, well-known structures and devices are shown in block diagram form rather than in detail in order to avoid obscuring embodiments of the present disclosure. In addition, features of the different embodiments described hereinafter may be combined with each other, unless specifically noted otherwise. The present disclosure will now be described with reference to the attached figures, wherein like reference numerals are used to refer to like elements throughout, and wherein the illustrated structures and devices are not necessarily drawn to scale.

It will be understood that when an element is referred to as being "electrically connected" or "electrically coupled" to another element, the element can be physically connected or coupled to the other element such that current and/or electromagnetic radiation can flow along a conductive path formed by the elements. Intervening conductive, inductive, or capacitive elements may be present between the element and the other element when the elements are described as being electrically coupled or connected to one another. Further, when electrically coupled or connected to one another, one element may be capable of inducing a voltage or current flow or propagation of an electro-magnetic wave in the other element without physical contact or intervening components. Further, when a voltage, current, or signal is referred to as being "applied" to an element, the voltage, current, or signal may be conducted to the element by way of a physical connection or by way of capacitive, electromagnetic, or inductive coupling that does not involve a physical connection.

Use of the word exemplary is intended to present concepts in a concrete fashion. The terminology used herein is for the purpose of describing particular examples only and is not intended to be limiting of examples. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

FIG. 1 illustrates an example of a conventional heat pipe 100. The heat pipe 100 includes a shell 110 made of a heat conductive material (e.g., a metal such as copper). The shell 110 is sealed and forms a vapor chamber within which a liquid (shown schematically by arrows in FIG. 1) and a wick structure 116 are disposed. The shell 110 includes a "hot" end 112 which is positioned proximate to a heat source (not shown) that is being cooled by the heat pipe 100. While the hot end 112 is depicted as being a physical termination of a tubular vapor chamber, in other examples, the hot end is not a physical "end" per se but is rather an area of the heat pipe that is proximate to or in contact with the heat source (e.g., a heat exchanger).

At the hot end 112 the heat from the heat source vaporizes the liquid, causing the vaporized liquid to travel to a "cool" end 114 of the heat pipe as shown by the arrows. The cool end 114 is positioned away from the heat source and often is positioned near the edge of a device where ambient air may aid in cooling. As with the hot end, while the cool end 114 is depicted as being a physical termination of a tubular vapor chamber, in other examples, the cool end is not a physical "end" per se but is rather an area of the heat pipe that is proximate to or in contact with a heat dissipation region (e.g., an edge of the device). At the cool end 114, the vaporized liquid returns to liquid form, thereby releasing heat from the heat source. The portion of a heat pipe that includes the cool end 114 is often called the "condenser" and the portion of the heat pipe that includes the hot end 112 is often called the "evaporator."

The wick structure 116 urges the liquid back to the hot end 112 to complete the cooling cycle. The wick structure 116 is illustrated as a conductive, fibrous material. However, the wick structure 116 may take any of a number of appropriate forms such as, for example, capillary features molded into the interior surface of the shell 110, a capillary sleeve insert, etc.

Figure 2:
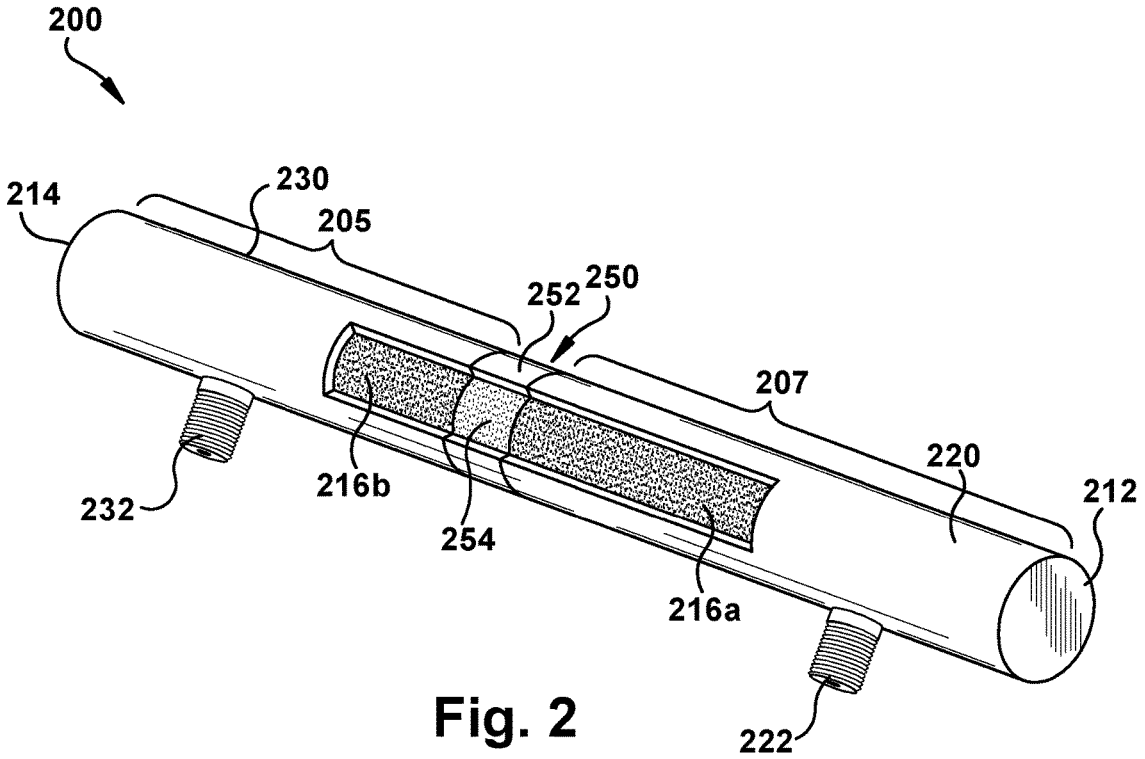
FIG. 2 illustrates an exemplary heat pipe including features that facilitate use of the heat pipe as part of a device antenna.

FIG. 2 illustrates an exemplary heat pipe 200 that is adapted for use as part of a radiating element of an antenna. For the purposes of this description, the term "radiating element" means a part of an antenna that is a conductive path along which RF waves travel prior to being transmitted by the antenna and/or after being received by the antenna. A radiating element conducts RF waves by design and is to be distinguished from other conductive elements within a device that may conduct RF waves (including interfering signals and so on) by happenstance and not according to the design of the device. For example, by design a monopole antenna includes a single radiating element while a dipole antenna includes two radiating elements. In a monopole antenna, a device ground plane acts as a virtual radiating element that forms a return path for the antenna current. In a dipole antenna one of the two radiating elements acts as a return path for the antenna current. The heat pipe configurations described herein are applicable to any antenna configuration, not just monopole or dipole antennas.

The heat pipe 200 includes a first conductive shell portion 220 and a second conductive shell portion 230. The first conductive shell portion includes a hot end 212 of the heat pipe 200 and the second conductive shell portion 230 includes a cool end 214 of the heat pipe 200. A first conductive wick portion 216*a* and a second conductive wick portion 216*b* are contained within the first conductive shell portion 220 and the second conductive shell portion 230, respectively. An insulator 250 is disposed between and connected to the shell portion 220 and the conductive shell portion 230. The insulator 250 includes an insulating shell portion 252 and an insulating wick portion 254 contained within the insulating shell portion. In one example, the insulating shell portion is made of a ceramic material. Together, the first conductive shell portion 220, the insulating shell portion 252, and the second conductive shell portion 230 form a continuous, sealed vapor chamber. A liquid (not shown) is contained within the vapor chamber.

A feed connection feature 232 is electrically connected to the second conductive shell portion 230. The feed connection feature 232 is configured to be connected to an RF feed line (not shown) of a device (not shown) that carries RF waves to and from processing components within the device. In the illustrated example, the feed connection feature 232 is a threaded connector configured to connect with a coaxial cable. In other examples, the feed connection feature 232 includes a solder point, pogo pins, or a spring type connection. In the illustrated example, the first conductive shell portion 220 includes a ground connection feature 222 configured to be connected to a ground of the device. In the illustrated example, the ground connection feature 222 is a threaded connector configured to connect with a coaxial cable. In other examples, the ground connection feature 222 includes a solder point, pogo pins, or a spring type connection.

The insulator 250 bisects the heat pipe 200 into two separate portions: a first radiating element portion 205 which includes the shell portion 230 and the conductive wick portion 216*a* and a second radiating element portion 207 which includes the shell portion 230 and the conductive wick portion 216*b*. The first radiating element portion 205 conducts RF waves from the feed connection feature 232 through the second conductive shell portion 230 and the conductive wick portion 216*b*. The second radiating element portion 207 conducts RF waves to the ground connection feature 222 through the second conductive shell portion 230 and the conductive wick portion 216*b*.

The first radiating element portion 205 and the second radiating element portion 207 are electrically isolated from one another by the insulator 250. The first radiating element portion 205 is included in a first radiating element of the device's antenna (not shown, see FIG. 3A). The second radiating element portion 207 is included in a second radiating element of the device's antenna (not shown, see FIG. 3A). Because the second radiating element portion 207 is electrically isolated from the first portion by the insulator 250, the second radiating element portion 207 will not have a significant impact on the response or conductive characteristics of the first radiating element portion 205 and vice versa. The position of the insulator 250 may be chosen based on the design requirements of the antenna so that the radiating element portions 205, 207 may be enlarged or reduced, depending on the specific antenna design, without affecting the performance or functioning of the heat pipe 200.

In one example, the heat pipe does not include a ground connection feature and a ground plane of the device serves as a return current path for the antenna. In other examples, both the feed connection feature 232 and the ground connection feature 222 are electrically connected to the first radiating element portion 205. In these examples, the second radiating element portion 207 is not part of a radiating element of the antenna but rather serves solely as a thermal management feature.

The heat pipe 200 includes wick portions 216*a* and 216*b* that are conductive, and thus, in addition to the second shell portion 230, the wick portion 216*a* conducts the RF waves from the feed connection feature 232. Therefore, to electrically isolate the wick portion 216*a* from the wick portion 216*b*, the insulating wick portion 254 is made of a non-conductive material such as a plastic or poly-tetra-fluoro-ethylene (PTFE). Together, the wick portions 216*a*, 216*b* and insulating wick portion 254 form a wicking path for the fluid in the heat pipe. In one example, the entire wick (e.g., 216*a*, 254, and 216*b*) is made of an insulating material such that the wick does not conduct (or conducts a negligible amount of) the RF waves from the feed connection feature 232. In this example, the insulator 250 includes the insulating shell portion 252 but does not include a separate wick portion. Instead, the entire wick structure (e.g., 216*a*, 254, and 216*b*) is made of an insulating material.

Figure 3A:
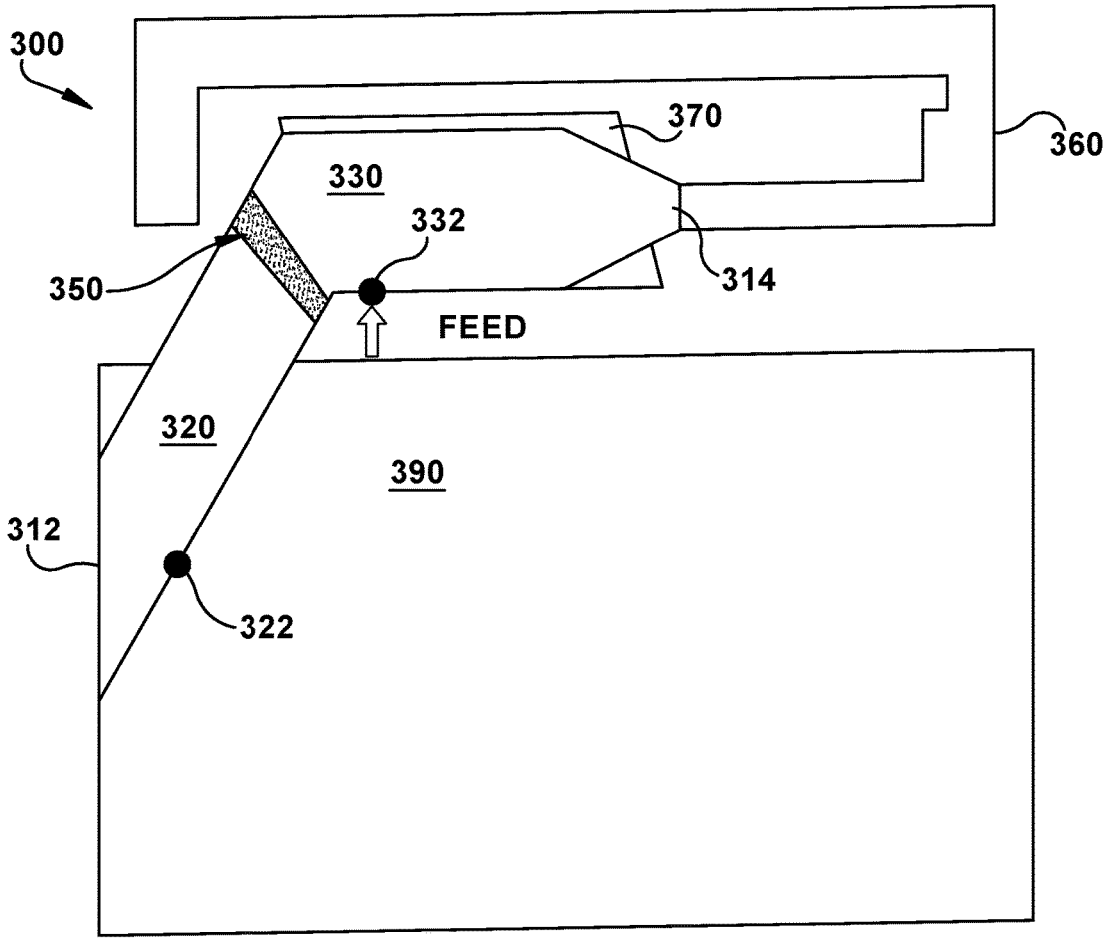
FIG. 3A illustrates a top plan view of an exemplary device antenna system that includes a heat pipe as part of a radiator element of the antenna.
Figure 3B:
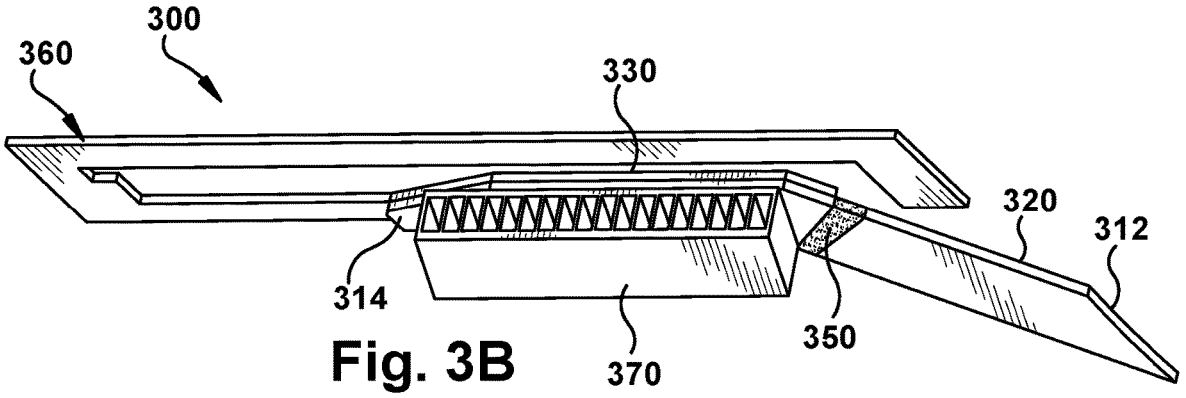
FIG. 3B illustrates a perspective view of the exemplary device antenna system of FIG. 3A.

FIGS. 3A and 3B illustrate an exemplary antenna system 300 for use in a device, such as a mobile device. The antenna system includes a heat pipe that includes a first conductive shell portion 320, an insulator 350, and a second conductive shell portion 330 as well as an internal wick structure (not shown) like the wick structure of FIG. 2. The heat pipe has a flattened shape which makes the heat pipe well suited for installation in a thin mobile device. The function of the heat pipe is unchanged regardless of the overall geometry of the heat pipe and thus the heat pipe in FIGS. 3A and 3B functions, in terms of thermal management, in the same manner as the heat pipes 100 and 200 of FIGS. 1 and 2.

A heat exchanger 370 is physically connected to the second conductive shell portion 330. Additional metal segments 360 having a geometry tailored based on a frequency range of an RF signal that will be transmitted/received by the antenna system 300 are connected to a cool end 314 of the heat pipe. Since the heat exchanger is metal the heat exchanger also functions as part of a first radiating element of the antenna system 300. Thus, one antenna radiating element of the system 300 includes the second conductive shell portion 330, the metal segments 360, and the heat exchanger 370. A feed connection feature 332 is provided on the second conductive shell portion 330 and is electrically connected to a feed line of a device in which the antenna system is installed. In one example, the feed line is connected to a system on chip (SoC) of the device. A second radiating element for the antenna system 300 is formed by the first conductive shell portion 320, which includes a hot end 312 of the heat pipe. A ground connection feature 322 electrically connects the first conductive shell portion to a ground plane 390 of the device.

Figure 4:
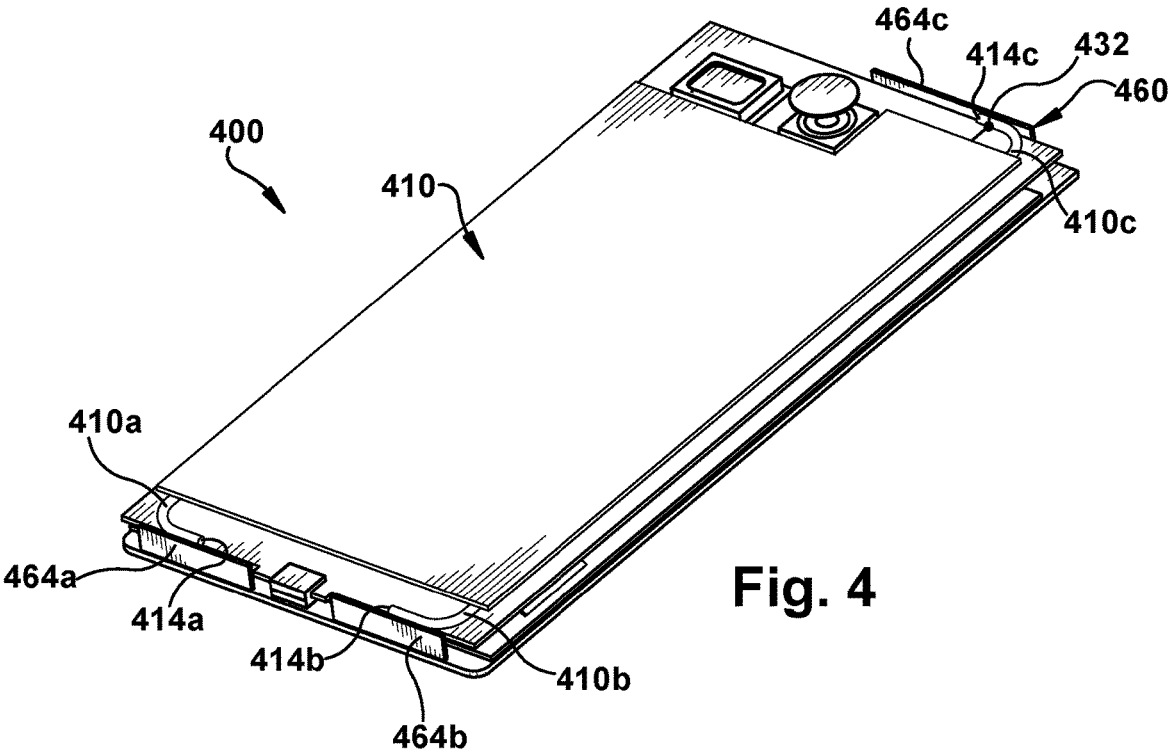
FIG. 4 illustrates an exemplary device antenna system that includes antennas that include a heat pipe.

FIG. 4 illustrates an antenna system 400 that includes a heat pipe with a central flattened vapor chamber defined by central shell portion 410 and three tubular extensions 410*a*-410*c* of the vapor chamber. While the heat dissipation device in FIG. 4 is referred to as a heat or vapor chamber, the use of the term chamber merely refers to the flattened shape of the chamber 410. The heat dissipation function of the heat or vapor chamber 410 and 410*a*-410*c* is the same as that of the heat pipes illustrated in FIGS. 1-3. The central vapor chamber portion 410 and the tubular extensions 410*a*-410*c* together form a continuous, sealed vapor chamber. A wicking structure and liquid (not shown) are contained within the central shell portion 410 and the three tubular extensions 10*a*-410*c*. The flattened shape of the heat pipe central shell portion is well adapted for use in a device because the flattened shape provides significant surface area for heat dissipation.

The central vapor chamber portion 410 includes a hot end of the heat pipe (not shown) that is near or in contact with a heat source within a device. The tubular extensions 410*a*-410*c* each include a cool end 414*a*-414*c*, respectively, of the heat pipe. A metal segment 464*a*-464*c* is attached to each tubular extension 410*a*-410*c*, respectively. The metal segment has a geometry that is conducive to conducting RF waves having a certain frequency. Each combination of tubular extension 410 and metal segment 464 forms a different antenna in the antenna system 400. A feed feature for each antenna, like feed feature 232 of FIG. 2, is installed on the vapor chamber 410 or tubular extensions 410*a*-410*c*. A feed line is illustrated as connected to the tubular extension 414*c* for reference. In one example, each metal segment and/or tubular extension has different geometry so that the different antennas may be adapted for transmitting different frequency ranges.

The antenna system 400 of FIG. 3 does not include an insulator, meaning that the tubular extensions are not electrically isolated from one another. However, in one example, one or more insulators (e.g., insulator 250 or 350, of FIGS. 2, 3A, and 3B) may be installed in the vapor chamber central portion 410 and/or tubular extensions 410*a*-410*c* to electrically isolate the antennas from one another.

It can be seen from the foregoing description that using a portion of a heat pipe as a portion of an antenna radiating element provides design flexibility while conserving space within a device.

Figure 5:
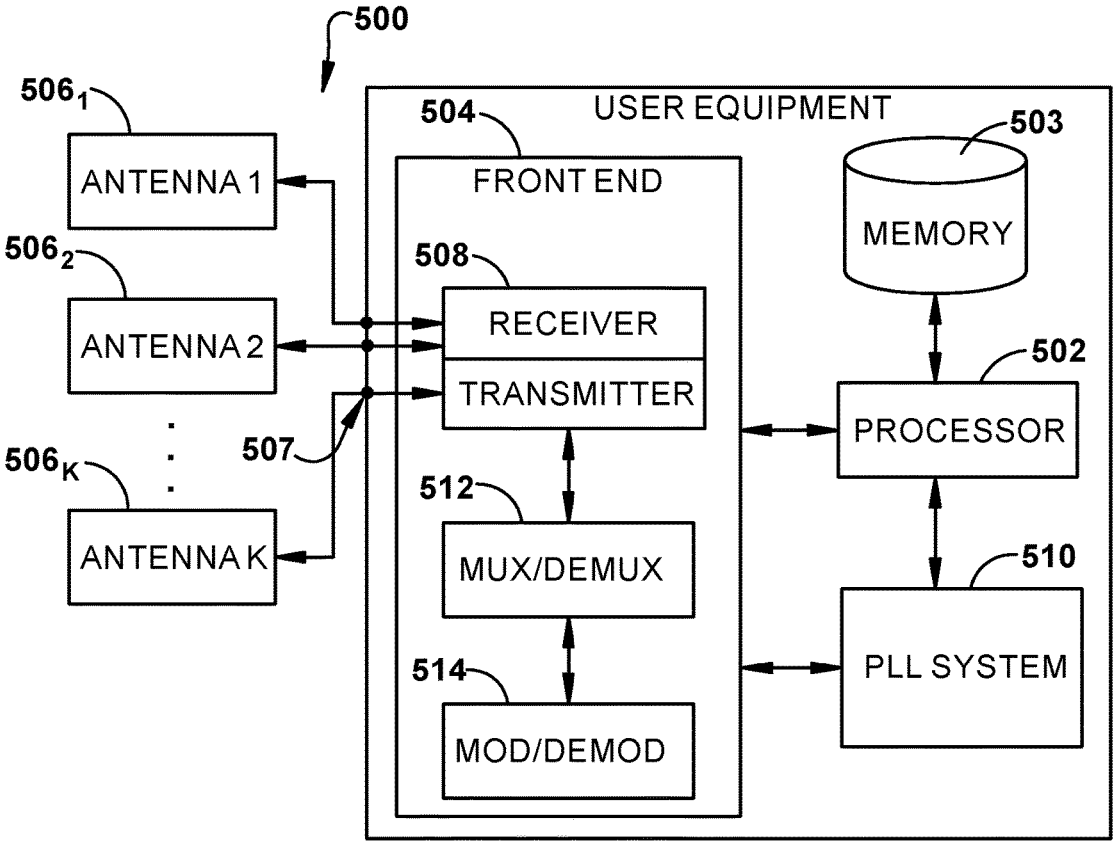
FIG. 5 illustrates a block diagram of an example of user equipment (e.g., a mobile device, communication device, personal digital assistant, etc.) that can enable and/or exploit features or aspects of the disclosed aspects.

To provide further context for various aspects of the disclosed subject matter, FIG. 5 illustrates a block diagram of an example of user equipment 500 (e.g., a mobile device, communication device, personal digital assistant, etc.) related to access of a network (e.g., base station, wireless access point, femtocell access point, and so forth) that can enable and/or exploit features or aspects of the disclosed aspects.

The user equipment or mobile communication device 500 can be utilized with one or more aspects of the dual purpose heat pipe/antenna configurations described herein according to various aspects. The user equipment device 500, for example, comprises a digital baseband processor 502 that can be coupled to a data store or memory 503, a front end 504 (e.g., an RF front end, an acoustic front end, or the other like front end) and a plurality of antenna ports 507 for connecting to a plurality of antennas $\mathbf{506}_1$ to 506*k* (k being a positive integer). The antennas $\mathbf{506}_1$ to $\mathbf{506}_k$ include at least a portion of a heat pipe as described above. The antennas $\mathbf{506}_1$ to 506*k* can receive and transmit signals to and from one or more wireless devices such as access points, access terminals, wireless ports, routers and so forth, which can operate within a radio access network or other communication network generated via a network device (not shown).

The user equipment 500 can be a radio frequency (RF) device for communicating RF signals, an acoustic device for communicating acoustic signals, or any other signal communication device, such as a computer, a personal digital assistant, a mobile phone or smart phone, a tablet PC, a modem, a notebook, a router, a switch, a repeater, a PC, network device, base station or a like device that can operate to communicate with a network or other device according to one or more different communication protocols or standards.

The front end 504 can include a communication platform, which comprises electronic components and associated circuitry that provide for processing, manipulation or shaping of the received or transmitted signals via one or more receivers or transmitters (e.g. transceivers) 508, a mux/demux component 512, and a mod/demod component 514. The front end 504 is coupled to the digital baseband processor 502 and the set of antenna ports 507, in which the set of antennas $\mathbf{506}_1$ to 506*k* can be part of the front end.

The processor 502 can confer functionality, at least in part, to substantially any electronic component within the mobile communication device 500, in accordance with aspects of the disclosure. The processor 502 is functionally and/or communicatively coupled (e.g., through a memory bus) to memory 503 in order to store or retrieve information necessary to operate and confer functionality, at least in part, to communication platform or front end 504, a phase locked loop system 510.

The processor 502 can operate to enable the mobile communication device 500 to process data (e.g., symbols, bits, or chips) for multiplexing/demultiplexing with the mux/demux component 512, or modulation/demodulation via the mod/demod component 514, such as implementing direct and inverse fast Fourier transforms, selection of modulation rates, selection of data packet formats, inter-packet times, etc. Memory 503 can store data structures (e.g., metadata), code structure(s) (e.g., modules, objects, classes, procedures, or the like) or instructions, network or device information such as policies and specifications, attachment protocols, code sequences for scrambling, spreading and pilot (e.g., reference signal(s)) transmission, frequency offsets, cell IDs, and other data for detecting and identifying various characteristics related to RF input signals, a power output or other signal components during power generation.

While the invention has been illustrated and described with respect to one or more implementations, alterations and/or modifications may be made to the illustrated examples without departing from the spirit and scope of the appended claims. In particular regard to the various functions performed by the above described components or structures (assemblies, devices, circuits, systems, etc.), the terms (including a reference to a "means") used to describe such components are intended to correspond, unless otherwise indicated, to any component or structure which performs the specified function of the described component (e.g., that is functionally equivalent), even though not structurally equivalent to the disclosed structure which performs the function in the herein illustrated exemplary implementations of the invention.

Examples can include subject matter such as a method, means for performing acts or blocks of the method, at least one machine-readable medium including instructions that, when performed by a machine cause the machine to perform acts of the method or of an apparatus or system for concurrent communication using multiple communication technologies according to embodiments and examples described herein.

Example 1 is a heat pipe, including a first conductive shell portion; a second conductive shell portion; and an insulating shell portion disposed between and connected to the first conductive shell portion and the second conductive shell portion. A wick structure is disposed within the first conductive shell portion, the second conductive shell portion, and the insulating shell portion.

Example 2 includes the subject matter of example 1, including or excluding optional elements, wherein the insulating shell portion includes a ceramic material.

Example 3 includes the subject matter of example 1, including or excluding optional elements, wherein the first conductive shell portion includes a feed connection feature configured to form an electrical connection with a radio frequency (RF) feed line.

Example 4 includes the subject matter of example 1, including or excluding optional elements, wherein the feed connection feature includes a spring.

Example 5 includes the subject matter of example 3, including or excluding optional elements, wherein the feed connection feature includes a threaded connector adapted for connection with a coaxial cable.

Example 6 includes the subject matter of example 3, including or excluding optional elements, wherein the feed connection feature includes one or more pogo pins.

Example 7 includes the subject matter of example 3, including or excluding optional elements, wherein the second conductive shell portion includes a ground connection feature configured to form an electrical connection with a ground of a device.

Example 8 includes the subject matter of examples 1-7, including or excluding optional elements, wherein the wick structure includes a first conductive wick portion contained within the first conductive shell portion; a second conductive wick portion contained within the second conductive shell portion; and an insulating wick portion contained within the insulating shell portion. The first conductive wick portion, the second conductive wick portion and the insulating wick portion together form a wicking path within the sealed chamber.

Example 9 includes the subject matter of example 8, including or excluding optional elements, wherein the insulating wick portion includes a plastic material.

Example 10 includes the subject matter of example 1, including or excluding optional elements, wherein the first conductive shell portion, the second conductive shell portion, and the insulating shell portion together form a sealed chamber.

Example 11 is an antenna system, including a first radiator element including a first portion of a heat pipe, and a second radiator element including a second portion of the heat pipe that is electrically isolated from the first portion.

Example 12 includes the subject matter of example 11, including or excluding optional elements, wherein the first radiator element is electrically connected to an RF feed line.

Example 13 includes the subject matter of example 12, including or excluding optional elements, wherein the second radiator element is connected to a device ground.

Example 14 includes the subject matter of examples 11-13, including or excluding optional elements, wherein the first radiator element includes a metal segment electrically connected to the first portion.

Example 15 is an antenna for a device including a tubular extension of a central vapor chamber extending toward an edge of the device and a feed connection feature electrically connected to the tubular extension. The feed connection feature is configured to connect to an RF feed line of the device.

Example 16 includes the subject matter of example 15, including or excluding optional elements, further including a ground connection feature configured to electrically connect to a ground of the device.

Example 17 includes the subject matter of examples 15-16, including or excluding optional elements, further including a plurality of tubular extensions.

Example 18 includes the subject matter of examples 15-16, including or excluding optional elements, further including a metal segment connected to the tubular extension.

Example 19 includes the subject matter of examples 15-16, including or excluding optional elements, further including a ground plane of the device, wherein the ground plane provides a return current path for the antenna.

Example 20 includes the subject matter of examples 15-16, including or excluding optional elements, wherein the vapor chamber and the tubular extension enclose a liquid and a wicking structure configured to carry the liquid.

The foregoing description of one or more implementations provides illustration and description, but is not intended to be exhaustive or to limit the scope of the example embodiments to the precise form disclosed. Modifications and variations are possible in light of the above teachings or may be acquired from practice of various implementations of the example embodiments.

The above description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize.

In this regard, while the disclosed subject matter has been described in connection with various embodiments and corresponding Figures, where applicable, it is to be understood that other similar embodiments can be used or modifications and additions can be made to the described embodiments for performing the same, similar, alternative, or substitute function of the disclosed subject matter without deviating therefrom. Therefore, the disclosed subject matter should not be limited to any single embodiment described herein, but rather should be construed in breadth and scope in accordance with the appended claims below.

In particular regard to the various functions performed by the above described components (assemblies, devices, circuits, systems, etc.), the terms (including a reference to a "means") used to describe such components are intended to correspond, unless otherwise indicated, to any component or structure which performs the specified function of the described component (e.g., that is functionally equivalent), even though not structurally equivalent to the disclosed structure which performs the function in the herein illustrated exemplary implementations of the disclosure. In addition, while a particular feature may have been disclosed with respect to only one of several implementations, such feature may be combined with one or more other features of the other implementations as may be desired and advantageous for any given or particular application.

The invention claimed is:

1. A heat pipe, comprising:

a first conductive shell portion;

a second conductive shell portion;

an insulating shell portion disposed between the first conductive shell portion and the second conductive shell portion, wherein the insulating shell portion electrically insulates the first conductive shell portion from the second conductive shell portion; and a wick structure disposed in the first conductive shell portion, the second conductive shell portion, and the insulating shell portion.

2. The heat pipe of claim 1, wherein the insulating shell portion comprises a ceramic material.

3. The heat pipe of claim 1, wherein the first conductive shell portion comprises a feed connection feature configured to form an electrical connection with a radio frequency (RF) feed line.

4. The heat pipe of claim 3, wherein the feed connection feature comprises a spring.

5. The heat pipe of claim 3, wherein the feed connection feature comprises a threaded connector adapted for connection with a coaxial cable.

6. The heat pipe of claim 3, wherein the feed connection feature comprises one or more pogo pins.

7. The heat pipe of claim 1, wherein the second conductive shell portion comprises a ground connection feature configured to form an electrical connection with a ground of a device.

8. The heat pipe of claim 1, wherein the wick structure comprises a first conductive wick portion disposed in the first conductive shell portion;

a second conductive wick portion disposed in the second conductive shell portion; and an insulating wick portion disposed in the insulating shell portion, wherein the first conductive wick portion, the second conductive wick portion and the insulating wick portion form a wicking path in the heat pipe, further wherein the insulating wick portion electrically insulates the first conductive wick portion from the second conductive wick portion.

9. The heat pipe of claim 8, wherein the insulating wick portion comprises a plastic material.

10. The heat pipe of claim 1, wherein the first conductive shell portion, the second conductive shell portion, and the insulating shell portion together form a sealed chamber.

11. The heat pipe of claim 1, wherein at least one of the first conductive shell portion or the second conductive shell portion is configured to conduct radio frequency (RF) waves.

12. The heat pipe of claim 8, wherein at least one of the first conductive wick portion or the second conductive wick portion is configured to conduct radio frequency (RF) waves.

13. A method, comprising:

providing a heat pipe comprising:

a first conductive shell portion;

a second conductive shell portion;

an insulating shell portion disposed between the first conductive shell portion and the second conductive shell portion, wherein the insulating shell portion electrically isolates the first conductive shell portion from the second conductive shell portion; and a wick structure disposed in the first conductive shell portion, the second conductive shell portion, and the insulating shell; and radiating radio frequency (RF) waves with the first conductive shell portion.

14. The method of claim 13, further comprising receiving the RF waves from a feed connection feature coupled to the first conductive shell portion, wherein the feed connection feature is configured to form an electrical connection with a radio frequency (RF) feed line.

15. The method of claim 13, further comprising conducting radio frequency (RF) waves to ground with the second conductive shell portion.

16. The method of claim 15, further comprising conducting the RF waves to a ground connection feature configured to form an electrical connection with a ground of a device.

17. The method of claim 13, further comprising conducting the RF waves with a first conductive wick portion of the wick structure, wherein the first conductive wick portion is disposed in the first conductive shell portion.

* * * * *